US011450270B2

(12) United States Patent
Chen et al.

(10) Patent No.: US 11,450,270 B2
(45) Date of Patent: Sep. 20, 2022

(54) PIXEL CIRCUIT AND METHOD OF DRIVING THE SAME, DISPLAY DEVICE

(71) Applicant: BOE TECHNOLOGY GROUP CO., LTD., Beijing (CN)

(72) Inventors: Liang Chen, Beijing (CN); Lei Wang, Beijing (CN); Dongni Liu, Beijing (CN); Li Xiao, Beijing (CN); Minghua Xuan, Beijing (CN); Xiaochuan Chen, Beijing (CN); Shengji Yang, Beijing (CN); Pengcheng Lu, Beijing (CN); Detao Zhao, Beijing (CN); Ning Cong, Beijing (CN)

(73) Assignee: Beijing BOE Technology Development Co., Ltd., Beijing (CN)

( * ) Notice: Subject to any disclaimer, the term of this patent is extended or adjusted under 35 U.S.C. 154(b) by 334 days.

(21) Appl. No.: 16/484,621

(22) PCT Filed: Jan. 25, 2019

(86) PCT No.: PCT/CN2019/073218
§ 371 (c)(1),
(2) Date: Aug. 8, 2019

(87) PCT Pub. No.: WO2019/237748
PCT Pub. Date: Dec. 19, 2019

(65) Prior Publication Data

US 2021/0335233 A1 Oct. 28, 2021

(30) Foreign Application Priority Data

Jun. 13, 2018 (CN) ..... 201810607789.5

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0426* (2013.01);
(Continued)

(58) Field of Classification Search
None
See application file for complete search history.

(56) References Cited

U.S. PATENT DOCUMENTS 9,972,249 B2 5/2018 Zhang et al.
2006/0125807 A1 6/2006 Park et al.
(Continued)

FOREIGN PATENT DOCUMENTS

CN 105405395 A 3/2016
CN 106448566 A 2/2017
(Continued)

OTHER PUBLICATIONS

Indian Office Action in Indian Application No. 201917036399 dated Feb. 5, 2021.
(Continued)

*Primary Examiner* — Matthew Yeung
(74) *Attorney, Agent, or Firm* — Collard & Roe, P.C.

(57) ABSTRACT

A pixel circuit and a method of driving the same, and a display device. The pixel circuit includes a plurality of pixel compensation circuits, and each pixel compensation circuit can be connected to M light-emitting units located in the same column. Each light-emitting control signal terminal of the M light-emitting control signal terminals included in each light-emitting control signal terminal group may be connected to a pixel compensation circuit group (i.e., K rows of pixels compensation circuits).

20 Claims, 6 Drawing Sheets

(52) U.S. Cl.
CPC ..... *G09G 2300/0842* (2013.01); *G09G 2320/0233* (2013.01); *G09G 2320/045* (2013.01); *G09G 2330/021* (2013.01)

(56) References Cited

U.S. PATENT DOCUMENTS

| | | | | |
|---|---|---|---|---|
| 2011/0025678 | A1* | 2/2011 | Chung | G09G 3/3233 345/213 |
| 2014/0292740 | A1 | 10/2014 | Tseng et al. | |
| 2017/0148389 | A1 | 5/2017 | Zhou | |
| 2017/0200412 | A1* | 7/2017 | Gu | G09G 5/005 |
| 2020/0035158 | A1 | 1/2020 | Yang et al. | |

FOREIGN PATENT DOCUMENTS

| | | | |
|---|---|---|---|
| CN | 106782301 | A | 5/2017 |
| CN | 107170408 | A | 9/2017 |
| CN | 108806612 | A | 11/2018 |

OTHER PUBLICATIONS

Notice of Transmittal of the International Search Report of PCT/CN2019/073218 in Chinese, dated Apr. 26, 2019.
International Preliminary Report on Patentability of PCT/CN2019/073218, issuance date Dec. 15, 2020 and English Translation of the Written Opinion of the International Searching Authority of PCT/CN2019/073218, dated Apr. 26, 2019.
International Search Report of PCT/CN2019/073218 in Chinese, dated Apr. 26, 2019, with English translation.
Extended European Search Report in European Application No. 19755798.6 dated Mar. 30, 2022.

* cited by examiner

PIXEL CIRCUIT AND METHOD OF DRIVING THE SAME, DISPLAY DEVICE

CROSS REFERENCE TO RELATED APPLICATIONS

This application is the National Stage of PCT/CN2019/073218 filed on Jan. 25, 2019, which claims priority under 35 U.S.C. § 119 of Chinese Application No. 201810607789.5 filed on Jun. 13, 2018, the disclosure of which is incorporated by reference.

TECHNICAL FIELD

Embodiments of the present disclosure relate to a pixel circuit and a method of driving the same, and a display device.

BACKGROUND

Active Matrix Organic Light Emitting Diode (AMOLED) is a self-luminous current-driven light emitting device, which is increasingly used in high-performance display panels due to its characteristics such as a fast response speed, a high refresh frequency, low power consumption, etc.

In the related art, a display panel generally includes a plurality of pixel units arranged in an array, and each of the pixel units includes a light-emitting unit and a pixel compensation circuit connected to the light-emitting unit. The pixel compensation circuit can avoid the difference in the magnitude of the current flowing through the light-emitting unit due to the drifting of the threshold voltage of the driving transistor driving the light-emitting unit, thereby ensuring the uniformity of the display brightness of the display panel.

The number of pixel compensation circuits will increase as the number of pixel units in the display panel increases, and the area occupied by the pixel compensation circuits will also become larger, which is not conducive to the implementation of the display panel with a narrow bezel.

SUMMARY

At least one embodiment of the present disclosure provides a pixel circuit, the pixel circuit comprising a plurality of pixel compensation circuit groups arranged in an array, each pixel compensation circuit group comprising K rows of pixel compensation circuits, K being an integer greater than 1, and each row of pixel compensation circuits comprising at least one pixel compensation circuit;

wherein each pixel compensation circuit is configured to be connected to a light-emitting unit group in operation, the light-emitting unit group comprises M light-emitting units located in a same column, M is an integer greater than one;

the pixel circuit further comprises a plurality of light-emitting control signal terminal groups that are in one-to-one correspondence with the plurality of pixel compensation circuit groups, each light-emitting control signal terminal group comprises M light-emitting control signal terminals, and each pixel compensation circuit of each pixel compensation circuit group is connected to M light-emitting control signal terminals of a corresponding light-emitting control signal terminal group; and the M light-emitting control signal terminals connected to each pixel compensation circuit are in one-to-one correspondence with the M light-emitting units connected to the pixel compensation circuit, and each light-emitting control signal terminal is configured to drive a corresponding light-emitting unit to emit light through the pixel compensation circuit connected to the light-emitting control signal terminal.

Optionally, the pixel circuit further comprises a plurality of main light-emitting control signal terminals that are in one-to-one correspondence with the plurality of pixel compensation circuit groups, and each main light-emitting control signal terminal is connected to each pixel compensation circuit of a corresponding pixel compensation circuit group.

Optionally, the M light-emitting units located in the same column of each light-emitting unit group are adjacent to each other.

Optionally, M=2.

Optionally, the K rows of pixel compensation circuits of each pixel compensation circuit group are adjacent to each other.

Optionally, K=2.

Optionally, an m-th light-emitting control signal terminal of the M light-emitting control signal terminals connected to each pixel compensation circuit corresponds to an m-th light-emitting unit of the M light-emitting units connected to the pixel compensation circuit, and m is a positive integer not greater than M.

Optionally, each pixel compensation circuit comprises a reset sub-circuit, a first light-emitting control sub-circuit, and M second light-emitting control sub-circuits;

the reset sub-circuit is connected to a reset signal terminal and a reset power supply terminal, the reset sub-circuit is connected to the first light-emitting control sub-circuit at a first node, and the reset sub-circuit is configured to input a reset power supply signal from the reset power supply terminal to the first node in response to a reset signal from the reset signal terminal;

the first light-emitting control sub-circuit is connected to the main light-emitting control signal terminal, a power supply terminal, a data signal terminal and a driving power supply terminal, the first light-emitting control sub-circuit is connected to the M second light-emitting control sub-circuits at a second node, and the first light-emitting control sub-circuit is configured to input a data signal from the data signal terminal to the second node in response to a potential of the first node, a main light-emitting control signal from the main light-emitting control signal terminal, a power supply signal from the power supply terminal, and a drive power supply signal from the drive power supply terminal; and each second light-emitting control sub-circuit is connected to one light-emitting control signal terminal of a corresponding light-emitting control signal terminal group and a light-emitting unit, and each second light-emitting control sub-circuit is configured to drive the light-emitting unit connected to the second light-emitting control sub-circuit to emit light in response to an light-emitting control signal from the light-emitting control signal terminal connected to the second light-emitting control sub-circuit.

Optionally, each second light-emitting control sub-circuit comprises a first transistor;

a gate electrode of the first transistor is connected to one light-emitting control signal terminal, a first electrode of the first transistor is connected to the second node, and a second electrode of the first transistor is connected to one light-emitting unit.

Optionally, the reset sub-circuit comprises a second transistor;

a gate electrode of the second transistor is connected to the reset signal terminal, a first electrode of the second transistor is connected to a reset power supply terminal, and a second electrode of the second transistor is connected to the first node;

the first light-emitting control sub-circuit comprises a third transistor, a fourth transistor, a fifth transistor, a sixth transistor, and a storage capacitor;

a gate electrode of the third transistor is connected to the driving power supply terminal, a first electrode of the third transistor is connected to the data signal terminal, and a second electrode of the third transistor is connected to a third node;

a gate electrode of the fourth transistor is connected to the main light-emitting control signal terminal, a first electrode of the fourth transistor is connected to the third node, and a second electrode of the fourth transistor is connected to the power supply terminal;

a gate electrode of the fifth transistor is connected to the first node, a first electrode of the fifth transistor is connected to the third node, and a second electrode of the fifth transistor is connected to the second node;

a gate electrode of the sixth transistor is connected to the driving power supply terminal, a first electrode of the sixth transistor is connected to the first node, and a second electrode of the sixth transistor is connected to the second node; and an terminal of the storage capacitor is connected to the power supply terminal, and a remaining terminal of the storage capacitor is connected to the first node.

At least one embodiment of the present disclosure provides a method of driving a pixel circuit, which is applicable to the pixel circuit as described above, the method comprising: driving the pixel circuit through M driving sub-frames, wherein each driving sub-frame comprises a plurality of driving stages, a number of the driving stages in each driving sub-frame is equal to a number of the pixel compensation circuit groups and a number of the light-emitting control signal terminal groups in the pixel circuit, and the plurality of driving stages are in one-to-one correspondence with the plurality of light-emitting control signal terminal groups, and the driving the pixel circuit through the M driving sub-frames comprises: during a light-emitting sub-stage of each driving stage, making a potential of a target light-emitting control signal provided by a target light-emitting control signal terminal of the M light-emitting control signal terminals in a corresponding light-emitting control signal terminal group to be a valid potential, making a potential of a light-emitting control signal provided by a remaining light-emitting control signal terminal other than the target light-emitting control signal terminal in the corresponding light-emitting control signal terminal group to be an invalid potential, and driving, by the pixel compensation circuit group connected to the target light-emitting control signal terminal, the light-emitting unit corresponding to the target light-emitting control signal terminal to emit light under a control of the target light-emitting control signal.

Optionally, the pixel circuit further comprises a plurality of main light-emitting control signal terminals that are in one-to-one correspondence with the plurality of pixel compensation circuit groups, each main light-emitting control signal terminal is connected to each pixel compensation circuit of a corresponding pixel compensation circuit group; and the driving the pixel circuit through the M driving sub-frames further comprises: during the light-emitting sub-stage of each driving stage, making a potential of a main light-emitting control signal provided by the main light-emitting control signal terminal corresponding to the pixel compensation circuit group connected to the target light-emitting control signal terminal to be a valid potential.

Optionally, each light-emitting unit group comprises two light-emitting units located in the same column and adjacent to each other, and each light-emitting control signal terminal group comprises two light-emitting control signal terminals;

the driving the pixel circuit by the M driving sub-frames comprises: driving the pixel circuit by two driving sub-frames; and the driving the pixel circuit by two driving sub-frames comprises:

during the light-emitting sub-stage of each driving stage of a first driving sub-frame of the two driving sub-frames, making a potential of a light-emitting control signal provided by one light-emitting control signal terminal of the light-emitting control signal terminal group corresponding to the driving stage to be a valid potential, and making a potential of a light-emitting control signal provided by a remaining light-emitting control signal terminal to be an invalid potential; and during the light-emitting sub-stage of each driving stage of a second driving sub-frame of the two driving sub-frames, making the potential of the light-emitting control signal provided by the remaining light-emitting control signal terminal of the light-emitting control signal terminal group corresponding to the driving stage to be a valid potential, and making the potential of the light-emitting control signal provided by the one light-emitting control signal terminal other than the remaining light-emitting control signal terminal to be an invalid potential.

Optionally, each pixel compensation circuit comprises a reset sub-circuit, a first light-emitting control sub-circuit, and M second light-emitting control sub-circuits;

each driving stages further comprises a reset sub-stage and K compensating sub-stages before the light-emitting sub-phase; and the driving the pixel circuit through the M driving sub-frames further comprises:

during the reset sub-phase, making a potential of a reset signal provided by a reset signal terminal of a first row of pixel compensation circuits of one pixel compensation circuit group connected to one light-emitting control signal terminal group corresponding to the driving stage to be a valid potential, and inputting, by the reset sub-circuit, a reset power supply signal from a reset power supply terminal to a first node in response to the reset signal;

during a k-th compensating sub-stage of the K compensating sub-stages, making a potential of a driving power supply signal provided by a driving power supply terminal connected to a k-th row of pixel compensation circuit of the one pixel compensation circuit group to be a valid potential, making a potential of a main light-emitting control signal provided by the main light-emitting control signal terminal connected to the one pixel compensation circuit group to be an invalid potential, and inputting, by the first light-emitting control sub-circuit of each pixel compensation circuit of the k-th row of pixel compensation circuits, a data signal from a data signal terminal to the second node in response to the driving power supply signal, a potential of the first node, and a power supply signal provided by a power supply terminal, k being a positive integer not greater than K; and during the light-emitting sub-stage, making a potential of the main light-emitting control signal connected to the one pixel compensating circuit group to be a valid potential, and driving, by the second light-emitting control sub-circuit, among the M second light-emitting control sub-circuits in each pixel compensation circuit of the one pixel compensation circuit group, connected to the target light-emitting control signal terminal, the light-emitting unit connected to the second light-emitting control sub-circuit to emit light in response to the target light-emitting control signal.

At least one embodiment of the present disclosure provides a display device, the display device comprising the pixel circuit as described above;

a plurality of light-emitting unit groups, each light-emitting unit group comprising M light-emitting units, M being an integer greater than 1, wherein each pixel compensation circuit in the pixel circuit is connected to one of the light-emitting unit groups.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1:
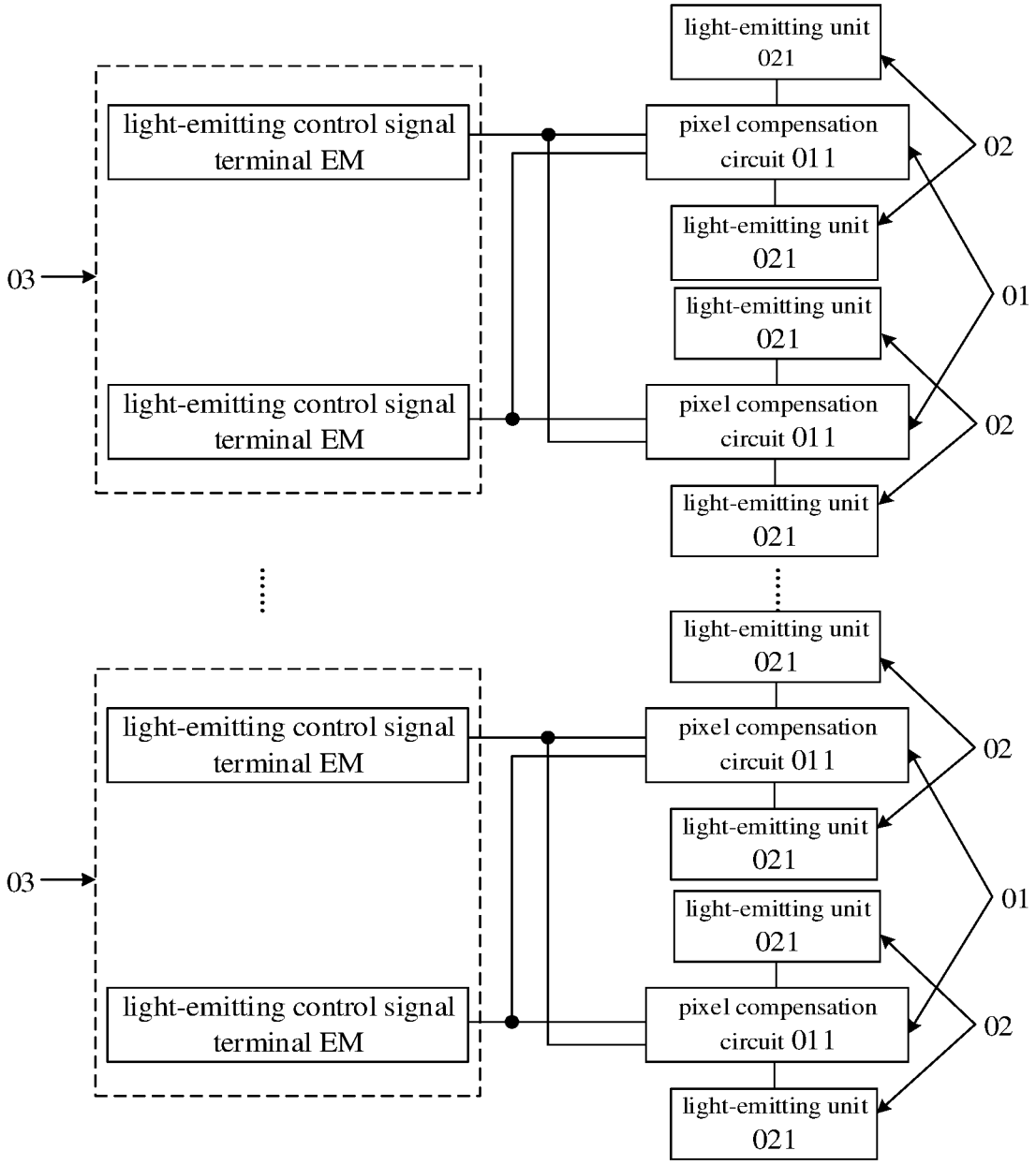
FIG. 1 is a schematic structural diagram of a pixel circuit provided by at least one embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The transistors adopted in all embodiments of the present disclosure may each be a thin film transistor (TFT) or a field effect transistor (FET) or other device with the same characteristics, and the transistors adopted in the embodiments of the present disclosure are mainly switching transistors according to the functions in the circuit. Because the source electrode and the drain electrode of the switching transistor adopted here are symmetrical, the source electrode and the drain electrode are interchangeable. In the embodiments of the present disclosure, the source electrode is referred to as a first electrode and the drain electrode is referred to as a second electrode. According to the form in the drawing, the middle terminal of the transistor is the gate electrode, the signal input terminal is the source electrode, and the signal output terminal is the drain electrode. In addition, the switching transistor adopted in the embodiments of the present disclosure may include any one of a P-type switching transistor and an N-type switching transistor. The P-type switching transistor is turned on when the gate electrode is at a low level and turned off when the gate electrode is at a high level, while the N-type switching transistor is turned on when the gate electrode is at a high level and turned off when the gate electrode is at a low level.

As mentioned in the present disclosure, the "valid potential" refers to a potential at which the switching transistor is turned on, and the "invalid potential" refers to a potential at which the switching transistor is turned off.

For example, an OLED display device generally includes a plurality of pixel cells arranged in an array, each of which may include, for example, a corresponding light-emitting driving circuit. In the OLED display device, the threshold voltages of the driving transistors in individual light-emitting driving circuits may differ due to the difference in the fabrication processes, and the threshold voltage of the driving transistor may drift due to, for example, the influence of temperature changes. Therefore, the difference in threshold voltages of the individual driving transistors may lead to a poor display effect (e.g., an uneven display effect), so it is necessary to compensate the threshold voltages. In addition, when the driving transistors are in the off state, the presence of leakage current may also lead to a poor display effect. Therefore, the industry also provides other light-emitting driving circuits with a compensation function based on the basic 2T1C light-emitting driving circuit (i.e., two transistors and one capacitor). The compensation function can be realized by voltage compensation, current compensation or hybrid compensation. The pixel circuit with the compensation function may be, for example, a 4T1C or 4T2C circuit, etc., which will not be described in detail herein.

FIG. 1 is a schematic structural diagram of a pixel circuit provided by at least one embodiment of the present disclosure. As shown in FIG. 1, the pixel circuit may include a plurality of pixel compensation circuit groups 01 arranged in an array, each pixel compensation circuit group 01 may include K rows of pixel compensation circuits 011, K is an integer greater than 1, and each row of pixel compensation circuits includes at least one pixel compensation circuit 011.

For example, in the pixel circuit shown in FIG. 1, each pixel compensation circuit group 01 includes two rows of pixel compensation circuits 011, i.e., K=2. Only one pixel compensation circuit 011 in each row of pixel compensation circuits is shown in FIG. 1, and actually each row of pixel compensation circuits may include a plurality of pixel compensation circuits 011.

In some embodiments of the present disclosure, each pixel compensation circuit 011 is configured to be connected to a light-emitting unit group 02 in operation, each light-emitting unit group 02 may include M light-emitting units 021 located in the same column, and M is an integer greater than 1. For example, in the pixel circuit shown in FIG. 1, each pixel compensation circuit 011 may be connected to two light-emitting units 021 located in the same column, i.e., M=2.

In addition, the pixel circuit may further include a plurality of light-emitting control signal terminal groups 03 that are in one-to-one correspondence with the plurality of pixel compensation circuit groups 01, and each light-emitting control signal terminal group 03 may include M light-emitting control signal terminals EM. Each pixel compensation circuit 011 in each pixel compensation circuit group 01 may be connected to M light-emitting control signal terminals EM in a corresponding light-emitting control signal terminal group 03.

For example, as shown in FIG. 1, each light-emitting control signal terminal group 03 may include two light-emitting control signal terminals EM, i.e., M=2, and each pixel compensation circuit 011 may be connected to two light-emitting control signal terminals EM of the light-emitting control signal terminal group 03. That is, each light-emitting control signal terminal EM in each light-emitting control signal terminal group 03 may be connected to each pixel compensation circuit 011 in each pixel compensation circuit group 01 (each pixel compensation circuit group 01 may include K rows of pixel compensation circuits, K being an integer greater than 1). Compared with the related art in which one pixel compensation circuit 011 is connected to one light-emitting control signal terminal EM, the number of signal terminals required to be disposed in the pixel circuit is reduced, and the area occupied by the pixel compensation circuit is reduced.

The M light-emitting control signal terminals EM connected to each pixel compensation circuit 011 are in one-to-one correspondence with the M light-emitting units 021 connected to the pixel compensation circuits 011, and each light-emitting control signal terminal EM may be used to drive the corresponding light-emitting unit 021 to emit light through the pixel compensation circuits 011 connected thereto. That is, in some embodiments of the present disclosure, one light-emitting control signal terminal EM may drive, through each pixel compensation circuit 011 to which it is connected, the light-emitting unit 021 corresponding to the light-emitting control signal terminal EM of a light-emitting unit group 02 connected to the pixel compensation circuit 011 to emit light.

The pixel circuit provided by at least one embodiment of the present disclosure may adopt M driving sub-frames when driving the light-emitting unit 021 to emit light, and each driving sub-frame may include a plurality of driving stages that are in one-to-one correspondence with the plurality of light-emitting control signal terminal groups 03. During each driving stage, a light-emitting control signal terminal group 03 of the plurality of light-emitting control signal terminal groups 03 corresponding to the driving stage is in an active state, a potential of a light-emitting control signal provided by only one target light-emitting control signal terminal of the light-emitting control signal terminal group 03 is an valid potential, and potentials of the light-emitting control signals provided by other light-emitting control signal terminals except the target light-emitting control signal terminal are invalid potentials. That is, during each driving stage of each driving sub-frame, in the pixel compensation circuit group 01 connected to the light-emitting control signal terminal group 03 in the active state, in the M light-emitting units 021 connected to each pixel compensation circuit 011, only the light-emitting unit 021 corresponding to the target light-emitting control signal terminal can emit light under the driving of the target light-emitting control signal.

For example, assuming that the pixel circuit adopts two driving sub-frames (i.e., M=2) when driving the light-emitting unit to emit light, during a certain driving stage of the first driving sub-frame, in the light-emitting control signal terminal group 03 corresponding to the driving stage, the potential of the light-emitting control signal provided by the first light-emitting control signal terminal EM may be an valid potential, that is, the first light-emitting control signal terminal EM is the target light-emitting control signal terminal. At this time, the light-emitting unit 021 corresponding to the first light-emitting control signal terminal EM emits light. During the driving stage of the second driving sub-frame, in the light-emitting control signal terminal group 03 corresponding to the driving stage, the potential of the light-emitting control signal provided by the second light-emitting control signal terminal EM may be an valid potential, that is, the second light-emitting control signal terminal EM is the target light-emitting control signal terminal. At this time, the light-emitting unit 021 corresponding to the second light-emitting control signal terminal EM emits light.

In summary, the pixel circuit provided by some embodiments of the present disclosure includes a plurality of pixel compensation circuits, and because each pixel compensation circuit can be connected to M light-emitting units located in the same column, that is, one pixel compensation circuit can be used to drive M light-emitting units, the number of pixel compensation circuits required to be disposed can be reduced. In addition, because each of the M light-emitting control signal terminals included in each light-emitting control signal terminal group can be connected to a pixel compensation circuit group (i.e., K rows of pixel compensation circuits), the number of signal terminals required to be disposed is reduced, and the area occupied by the pixel circuits is further reduced, which is more advantageous for the implementation of the display panel with a narrow bezel.

Figure 2:
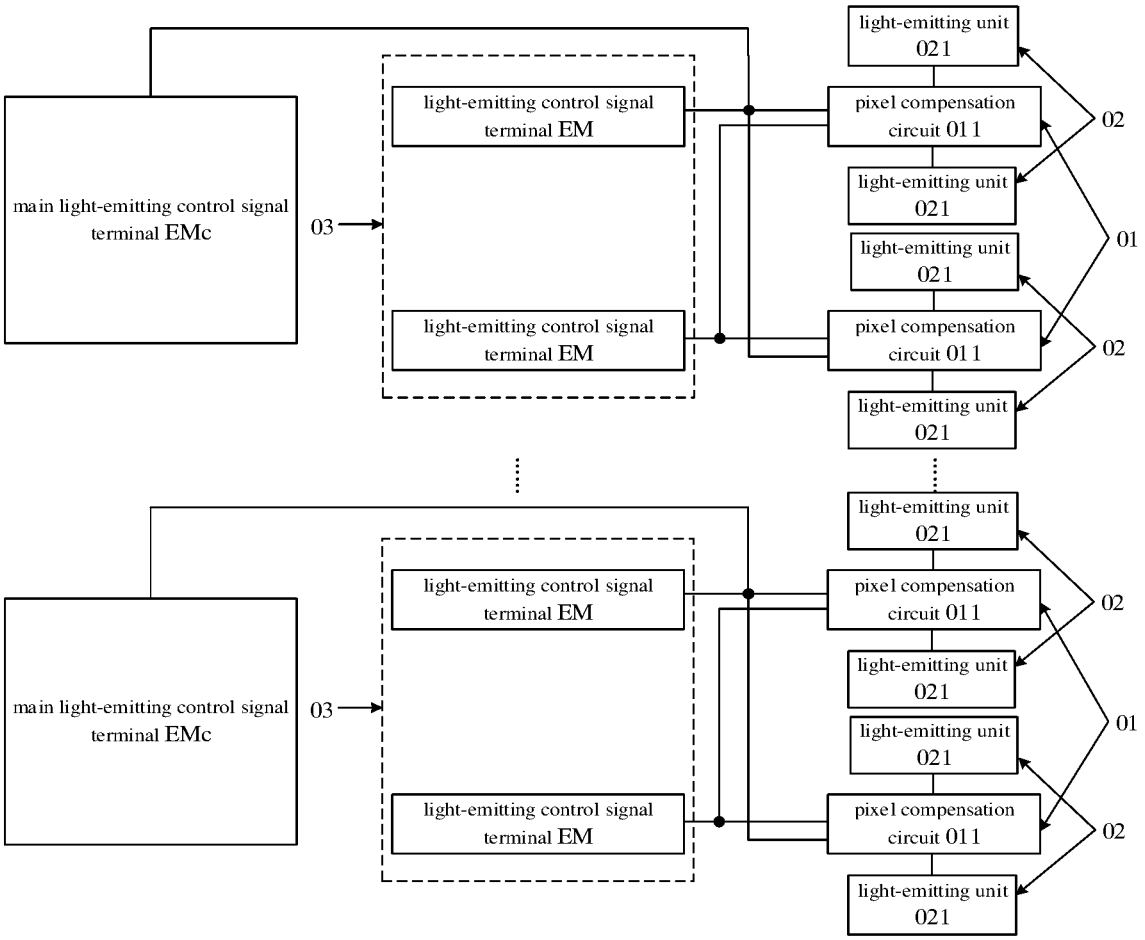
FIG. 2 is a schematic structural diagram of another pixel circuit provided by at least one embodiment of the present disclosure.

FIG. 2 is a schematic structural diagram of another pixel circuit provided by at least one embodiment of the present disclosure. As shown in FIG. 2, the pixel circuit may further include a plurality of main light-emitting control signal terminals EMc that are in one-to-one correspondence with the plurality of pixel compensation circuit groups 01, and each main light-emitting control signal terminal EMc may be connected to each pixel compensation circuit 011 of the corresponding pixel compensation circuit group 01. For example, as shown in FIG. 2, one main light-emitting control signal terminal EMc can be connected to two rows of pixel compensation circuit 011 in a pixel compensation circuit group 01.

The main light-emitting control signal terminal EMc can drive a light-emitting unit group 02 connected to the pixel compensation circuit 011 to emit light through each pixel compensation circuit 011 connected thereto.

In some embodiments of the present disclosure, because each main light-emitting control signal terminal EMc may be connected to each pixel compensation circuit 011 of the corresponding pixel compensation circuit group 01 (i.e., K rows of pixel compensation circuits), and because each pixel compensation circuit 011 can be connected to a light-emitting unit group 02 (each light-emitting unit group 02 may include M light-emitting units 021 located in the same column), one main light-emitting control signal terminal EMc can drive the M×K light-emitting unit to emit light through each pixel compensation circuit 011 of one pixel compensation circuit group 01. Compared with the related art in which one main light-emitting control signal terminal EMc drives a row of light-emitting units through a row of pixel compensation circuits 011 connected thereto, the number of signal terminals required to be disposed in the pixel circuit is further reduced, thereby reducing the area occupied by the pixel circuits.

For example, referring to FIG. 2, assuming that each light-emitting unit group 02 includes two light-emitting units 021 located in the same column, and one pixel compensation circuit group 01 includes two rows of pixel compensation circuits 011, one light-emitting control signal terminal EMc can drive four rows of light-emitting units 021 to operate through one pixel compensation circuit group 01.

Referring to FIGS. 1 and 2, assuming that each pixel compensation circuit 011 is connected to two light-emitting units 021 located in the same column, one light-emitting control signal terminal EM can control two rows of light-emitting units in some embodiments of the present disclosure; compared with the related art in which one light-emitting control signal terminal EM controls one row of light-emitting units, the number of light-emitting control signal terminals EM required to be disposed is reduced by half. Moreover, one main light-emitting control signal terminal EMc can control four rows of light-emitting units in some embodiments of the present disclosure; Compared with the related art in which one main light-emitting control signal terminal EMc controls one or two rows of light-emitting units, the number of main light-emitting control signal terminals EMc required to be disposed is effectively reduced.

Optionally, each light-emitting unit group 02 may include M light-emitting units 021 located in the same column and adjacent to each other. The adjacent M light-emitting units 021 share one pixel compensation circuit 011, which can minimize the length of the wire between the light-emitting unit 021 and the pixel compensation circuit 011, thereby reducing the wiring costs of the display panel and simplifying the manufacturing process of the display panel.

Optionally, each light-emitting unit group 02 may include two light-emitting units 021 located in the same column and adjacent to each other, i.e., M=2. When each light-emitting unit group 02 only include two adjacent light-emitting units 021 as shown in FIG. 1 and FIG. 2, the pixel compensation circuit 011 shared by the two light-emitting units 021 may be disposed between the two light-emitting units 021, so that the wiring costs can be further reduced.

Optionally, each pixel compensation circuit group 01 may include adjacent K rows of pixel compensation circuits. By taking the pixel compensation circuits 01 in adjacent rows as a group, it is possible to prevent the light-emitting control signal terminal EM from crossing the rows to be connected to the pixel compensation circuit 01, so that the wiring costs can be reduced.

Optionally, referring to FIGS. 1 and 2, each pixel compensation circuit group 01 may further include two adjacent rows of pixel compensation circuits 011. By taking the pixel compensation circuits 011 in two adjacent rows as a group, each light-emitting control signal terminal EM is only connected to two rows of pixel compensation circuits 011, that is, one control signal terminal EM is only required to simultaneously control two rows of light-emitting units 021, so that the display performance of the display panel is prevented from being affected while reducing the area occupied by the pixel compensation circuit.

In some embodiments of the present disclosure, the $m_{th}$ light-emitting control signal terminal of the M light-emitting control signal terminals connected to each pixel compensation circuit corresponds to the $m_{th}$ light-emitting unit of the M light-emitting units connected thereto, and m is a positive integer not greater than M. By making the light-emitting control signal terminal EM connected to each pixel compensation circuit 011 correspond to the light-emitting unit 021 connected to the pixel compensation circuit 011, each light-emitting control signal terminal group 03 can orderly drive, through the pixel compensation circuit 011, each row of the light-emitting units 021 at an equal row interval to emit light, so that a better display performance of the display panel can be obtained.

For example, it is assumed that two driving sub-frames are included. In the first driving sub-frame, the first light-emitting control signal terminal EM of each light-emitting control signal terminal group 03 can sequentially output the light-emitting control signal having a valid potential. Because the first light-emitting control signal terminal EM of each light-emitting control signal terminal group 03 corresponds to the first light-emitting unit 021 of the two light-emitting units 021 connected to the pixel compensation circuit 011 connected to the light-emitting control signal terminal EM, the first light-emitting control signal terminals EM of the light-emitting control signal terminal groups 03 can sequentially drive, through the pixel compensation circuits 011 connected thereto, the light-emitting units 021 of the odd-numbered rows to sequentially emit light, thereby realizing the orderly driving of the light-emitting units 021 at an equal row interval.

Figure 3:
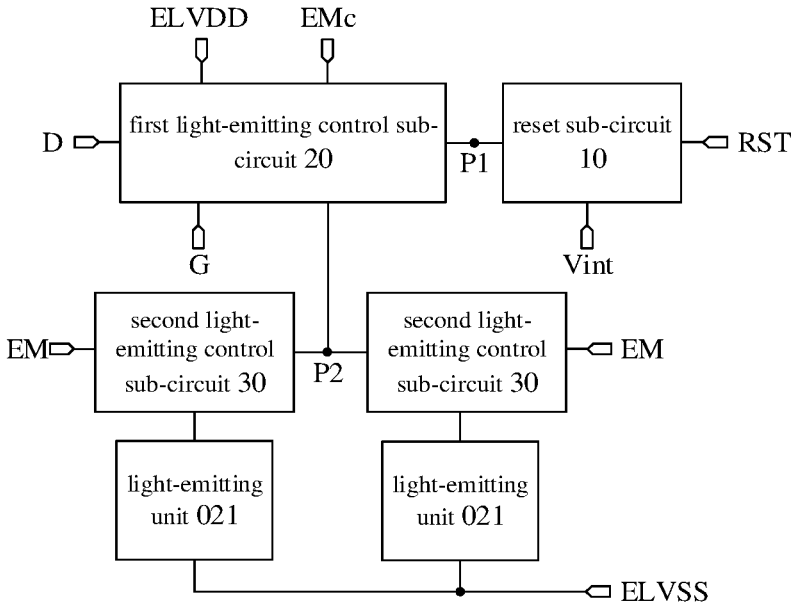
FIG. 3 is a schematic structural diagram of a pixel compensation circuit provided by at least one embodiment of the present disclosure.

FIG. 3 is a schematic structural diagram of a pixel compensation circuit according to at least one embodiment of the present disclosure. As shown in FIG. 3, each pixel compensation circuit 011 may include a reset sub-circuit 10, a first light-emitting control sub-circuit 20, and M second light-emitting control sub-circuits 30. For example, two second light-emitting control sub-circuits 30 are shown in FIG. 3.

Referring to FIG. 3, the reset sub-circuit 10 can be connected to a reset signal terminal RST, a reset power supply terminal Vint, and a first node P1, respectively. The reset sub-circuit 10 may be configured to input a reset power supply signal from the reset power supply terminal Vint to the first node P1 in response to a reset signal from the reset signal terminal RST.

For example, when the potential of the reset signal provided by the reset signal terminal RST is a valid potential, the reset sub-circuit 10 may input a reset power supply signal from the reset power supply terminal Vint to the first node P1, and the potential of the reset power supply signal can be a valid potential.

Referring to FIG. 3, the first light-emitting control sub-circuit 20 may be connected to the first node P1, a main light-emitting control signal terminal EMc, a power supply terminal ELVDD, a data signal terminal D, a driving power supply terminal G and a second node P2. The first light-emitting control sub-circuit 20 may be configured to input a data signal from the signal terminal D to the second node P2 in response to the potential of the first node P1, a main light-emitting control signal from the main light-emitting control signal terminal ECM, a power supply signal from the power supply terminal ELVDD, and a driving power supply signal from the driving power supply terminal G.

For example, when the potential of the driving power supply signal provided by the driving power supply terminal G is a valid potential, the potential of the main light-emitting control signal provided by the main light-emitting control signal terminal EMc is an invalid potential, the potential of the first node P1 is a valid potential, and the potential of the power supply signal provided by the power supply terminal ELVDD is an invalid potential, the first light-emitting control sub-circuit 20 may input the data signal from the data signal terminal D to the second node P2.

In some embodiments of the present disclosure, the pixel compensation circuits in the same row may be connected to the same driving power supply terminal G, and because each pixel compensation circuit may be connected to the M light-emitting units located in the same column, one driving power supply terminal G may drive M rows of the light-emitting units through one row of the pixel compensation circuits. Compared with the related art in which one driving power supply terminal G can drive only one row of the light-emitting units, the number of driving power supply terminals G required to be disposed in the pixel circuit provided by some embodiments of the present disclosure is reduced, thereby reducing the area occupied by the pixel circuits.

Referring to FIG. 3, each second light-emitting control sub-circuit 30 may be respectively connected to the second group of P2, one light-emitting control signal terminal EM of one corresponding light-emitting control signal terminal group and one light-emitting units 021. Each second light-emitting control sub-circuit 30 may be configured to drive the light-emitting unit 021 connected thereto to emit light in response to the light-emitting control signal supplied from the light-emitting control signal terminal EM to which the second light-emitting control sub-circuit 30 is connected.

For example, when the potential of the light-emitting control signal provided by one light-emitting control signal terminal EM in FIG. 3 is a valid potential, the second light-emitting control sub-circuit 30 may drive the light-emitting unit 021 corresponding to the light-emitting control signal terminal EM to emit light.

Figure 4:
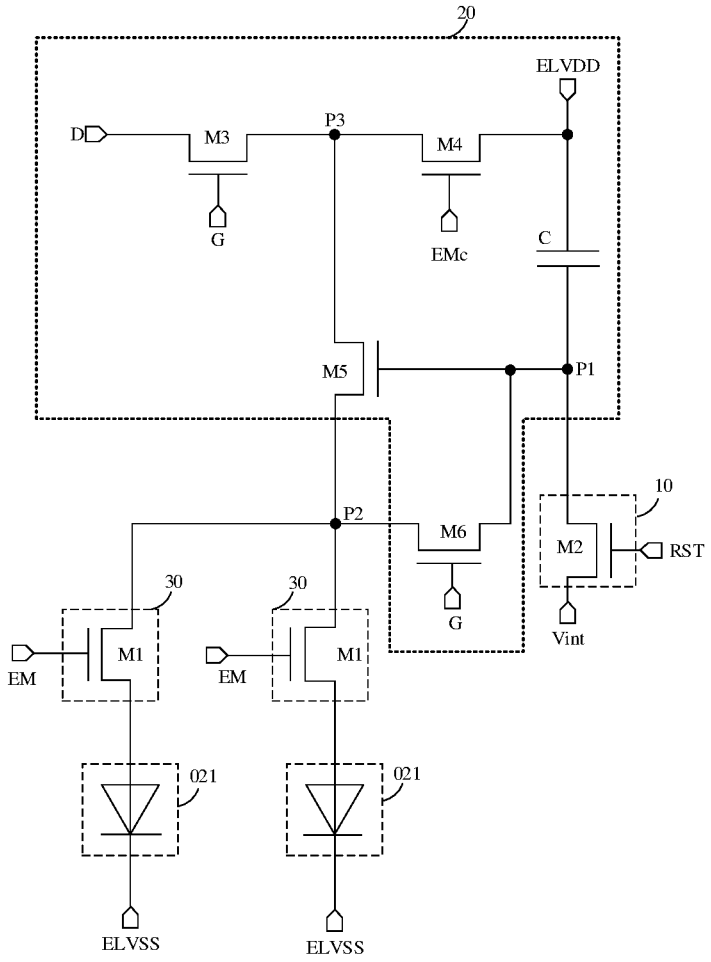
FIG. 4 is a schematic structural diagram of another pixel compensation circuit provided by at least one embodiment of the present disclosure.

FIG. 4 is a schematic structural diagram of another pixel compensation circuit according to at least one embodiment of the present disclosure. As shown in FIG. 4, each second light-emitting control sub-circuit 30 may include a first transistor M1.

For example, it is assumed that each pixel compensation circuit 011 is connected to two light-emitting units 021 located in the same column as shown in FIG. 1. Referring to FIG. 4, one pixel compensation circuit may include two first transistors M1, the gate electrode of each first transistor M1 may be connected to the light-emitting control signal terminal EM, the first electrode of the first transistor M1 may be connected to the second node P2, and the second electrode of the first transistor M1 may be connected to one light-emitting unit 021. Referring to FIG. 4, the other terminal of each light-emitting unit 021 may also be connected to the power supply terminal ELVSS having a low level. The light-emitting unit may be an organic light-emitting diode (OLED) or an AMOLED.

Optionally, referring to FIG. 4, the reset sub-circuit 10 may include a second transistor M2.

The gate electrode of the second transistor M2 may be connected to the reset signal terminal RST, the first electrode of the second transistor M2 may be connected to the reset power supply terminal Vint, and the second electrode of the second transistor M2 may be connected to the first node P1.

Optionally, referring to FIG. 4, the first light-emitting control sub-circuit 20 may include a third transistor M3, a fourth transistor M4, a fifth transistor M5, a sixth transistor M6, and a storage capacitor C.

Referring to FIG. 4, the gate electrode of the third transistor M3 may be connected to the driving power supply terminal G, the first electrode of the third transistor M3 may be connected to the data signal terminal D, and the second electrode of the third transistor M3 may be connected to the third Node P3.

The gate electrode of the fourth transistor M4 may be connected to the main light-emitting control signal terminal EMc, the first electrode of the fourth transistor M4 may be connected to the third node P3, and the second electrode of the fourth transistor M4 may be connected to the power supply terminal ELVDD.

The gate electrode of the fifth transistor M5 may be connected to the first node P1, the first electrode of the fifth transistor M5 may be connected to the third node P3, and the second electrode of the fifth transistor M5 may be connected to the second node P2.

The gate electrode of the sixth transistor M6 may be connected to the driving power supply terminal G, the first electrode of the sixth transistor M6 may be connected to the first node P1, and the second electrode of the sixth transistor M6 may be connected to the second node P2.

A terminal of the storage capacitor C may be connected to the power supply terminal ELVDD, and the other terminal may be connected to the first node P1.

Because the area of the pixel compensation circuit is negatively correlated with the screen resolution in the unit size (Pixels Per inch, PPI) of the display panel, that is, the larger the area of the pixel compensation circuit is, the lower the PPI of the display panel is. In some embodiments of the present disclosure, one pixel compensation circuit drives a plurality of light-emitting units to operate so that the number of pixel compensation circuits required to be disposed is reduced, thereby reducing the area occupied by the pixel compensation circuit. Moreover, in some embodiments of the present disclosure, each light-emitting control signal terminals and each main light-emitting control signal terminals are connected to each pixel compensation circuit of a pixel compensation circuit group (i.e., K rows of the pixel compensation circuits) so that the number of signal terminals required to be disposed in the pixel circuits is reduced. Therefore, the pixel circuit provided by some embodiments of the present disclosure occupies a small area, which can effectively increase the PPI of the display panel.

It should be noted that, in some embodiments of the present disclosure, the pixel compensation circuit may be a pixel compensation circuit of other structures, such as 6T1C or 9T1C, in addition to the structure of 7T1C (i.e., seven transistors and one capacitor) shown in FIG. 4, which is not limited by the embodiments of the present disclosure.

It should be noted that, in each of the above embodiments, the description has been made by taking an example in which each transistor is a P-type transistor and the valid potential is a low potential. Certainly, each transistor may also be an N-type transistor, and when each transistor is an N-type transistor, the valid potential is a high potential.

In summary, the pixel circuit provided by some embodiments of the present disclosure includes a plurality of pixel compensation circuits, and because each pixel compensation circuit may be connected to M light-emitting units located in the same column, that is, one pixel compensation circuit may be used to drive M light-emitting units, the number of pixel compensation circuits required to be disposed may be reduced. Furthermore, because each of the M light-emitting control signal terminals included in each light-emitting control signal terminal group may be connected to a pixel compensation circuit group (i.e., K rows of the pixel compensation circuits), the number of signal terminals required to be set is reduced, and the area occupied by the pixel circuits is further reduced, which is more advantageous for the implementation of the display panel of with a narrow bezel.

At least one embodiment of the present disclosure provides a method of driving a pixel circuit, which may be applied to the pixel circuit shown in FIG. 1, and the method may include driving the pixel circuit through M driving sub-frames. The number of driving sub-frames included in the driving method is equal to the number of light-emitting units connected to each pixel compensation circuit. In addition, the M driving sub-frames are in one-to-one correspondence with the M light-emitting units connected to each pixel compensation circuit, and in each driving sub-frame, among the M light-emitting units connected to each pixel compensation circuit, one light-emitting unit corresponding to the driving sub-frame emits light, and the remaining M−1 light-emitting units do not emit light.

Each driving sub-frame may include a plurality of driving stages, and the number of the driving stages included in each driving sub-frame may be equal to the number of the pixel compensation circuit groups and the number of the light-emitting control signal terminal groups included in the pixel circuit, and the plurality of driving stages are in one-to-one correspondence with the plurality of light-emitting control signal terminal groups.

Driving the pixel circuit through the M driving sub-frames may include that during a light-emitting sub-stage of each driving stage, the potential of the target light-emitting control signal provided by one target light-emitting control signal terminal of the M light-emitting control signal terminals included in the corresponding light-emitting control signal terminal group is an valid potential, the potentials of the light-emitting control signals provided by light-emitting control signal terminals other than the target light-emitting control signal terminal are an invalid potential, and a pixel compensation circuit group connected to the target light-emitting control signal terminal drives the corresponding light-emitting unit to emit light under the control of the target light-emitting control signal. That is, during each driving stage included in each driving sub-frame, only one light-emitting unit of the light-emitting unit group connected to each pixel compensation circuit emits light.

The light-emitting control signal terminals other than the target light-emitting control signal terminal refer to the M−1 light-emitting control signal terminals of the corresponding one light-emitting control signal terminal group except the one target light-emitting control signal terminal and the light-emitting control signal terminal groups of the plurality of the light-emitting control signal terminal groups other than the corresponding one light-emitting control signal terminal group.

In summary, in the method of driving the pixel circuit provided by at least one embodiment of the present disclosure, because during a light-emitting sub-stage of each driving stage, a pixel compensation circuit group (i.e., K rows of the pixel compensation circuits) connected to the target control signal terminal drives the corresponding light-emitting unit to emit light under the control of the target light-emitting control signal terminal, the number of signal terminals required to be disposed is reduced, and the area of the circuit board occupied by the pixel circuit is further reduced, which is more advantageous for the implementation of the display panel with a narrow bezel.

Referring to FIG. 2, the pixel circuit may further include a plurality of main light-emitting control signal terminals EMc that are in one-to-one correspondence with the plurality of pixel compensation circuit groups 01, and each main light-emitting control signal terminal EMc may be connected to each pixel compensation circuit 011 of the corresponding pixel compensation circuit group 01.

Correspondingly, driving the pixel circuit through the M driving sub-frames may further include that during a light-emitting sub-stage of each driving stage, the potential of the main light-emitting control signal provided by one main light-emitting control signal terminal corresponding to one pixel compensation circuit group connected to the target light-emitting control signal terminal is a valid potential.

Optionally, each light-emitting unit group may include two light-emitting units located in the same column and adjacent to each other, and each light-emitting control signal terminal group may include two light-emitting control signal terminals. Correspondingly, driving the pixel circuit through the M driving sub-frames may include driving the pixel circuit through two driving sub-frames.

Driving the pixel circuit through two driving sub-frames may include that: during the light-emitting sub-stage of each driving stage of the first driving sub-frame, the potential of the light-emitting control signal provided by one light-emitting control signal terminal of the light-emitting control signal terminal group corresponding to the driving stage may be a valid potential, and the potential of the light-emitting control signal provided by the other light-emitting control signal terminal may be an invalid potential; and during the light-emitting sub-stage of each driving stage of the second driving sub-frame, the potential of the light-emitting control signal provided by the other light-emitting control signal terminal of the light-emitting control signal terminal group corresponding to the driving stage may be a valid potential, and the potential of the light-emitting control signal provided by one light-emitting control signal terminal of the light-emitting control signal terminals other than the other light-emitting control signal terminal may be an invalid potential.

Optionally, each pixel compensation circuit group may include adjacent K rows of pixel compensation circuits. Correspondingly, during each light-emitting sub-stage, one light-emitting unit connected to each pixel compensation circuit of the K rows of pixel compensation circuits emits light.

Referring to FIG. 4, each pixel compensation circuit may include a reset sub-circuit 10, a first light-emitting control sub-circuit 20, and M second light-emitting control sub-circuits 30. Correspondingly, each driving stage may further comprise a reset sub-stage and K compensating sub-stages before the light-emitting sub-stage.

Figure 5:
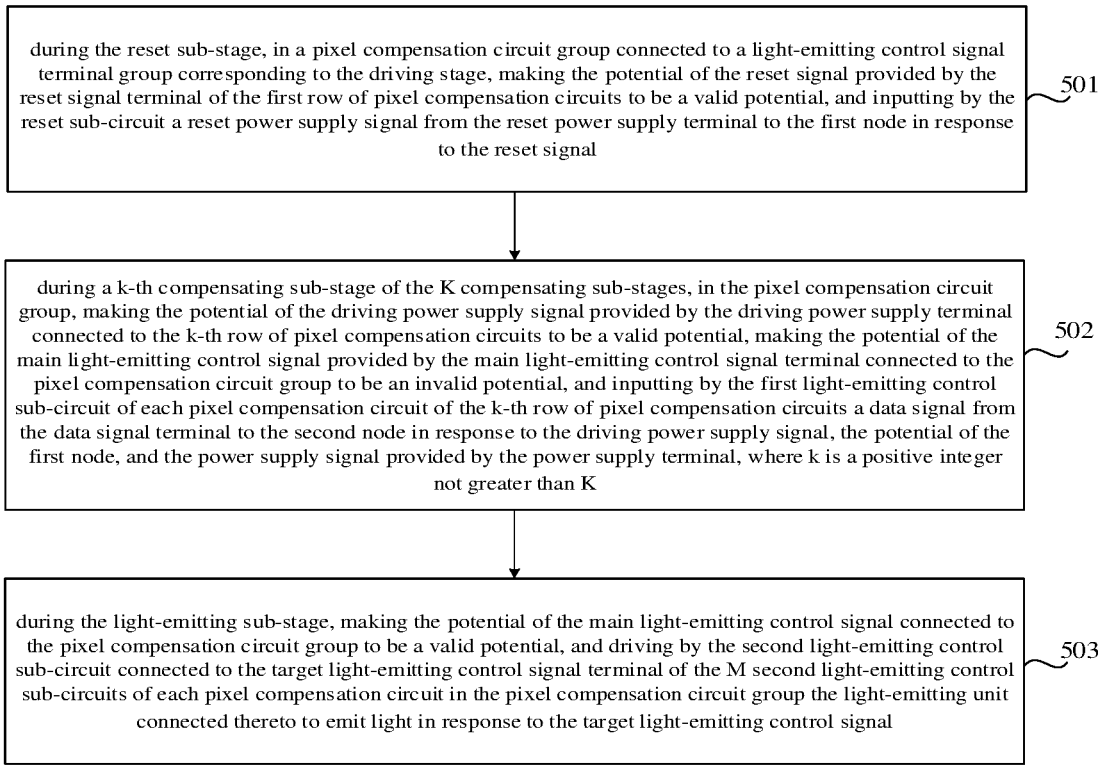
FIG. 5 is a flowchart of a method of driving a pixel circuit provided by at least one embodiment of the present disclosure.

FIG. 5 is a flowchart of a method of driving a pixel circuit according to at least one embodiment of the present disclosure. As shown in FIG. 5, the method may include:

Step 501: during the reset sub-stage, in a pixel compensation circuit group connected to a light-emitting control signal terminal group corresponding to the driving stage, making the potential of the reset signal provided by the reset signal terminal of the first row of pixel compensation circuits to be a valid potential, and inputting by the reset sub-circuit a reset power supply signal from the reset power supply terminal to the first node in response to the reset signal.

In addition, in the reset sub-stage, the potential of the main light-emitting control signal provided by the main light-emitting control signal terminal connected to each pixel compensation circuit group is an invalid potential.

Step 502: during a k-th compensating sub-stage of the K compensating sub-stages, in the pixel compensation circuit group, making the potential of the driving power supply signal provided by the driving power supply terminal connected to the k-th row of pixel compensation circuits to be a valid potential, making the potential of the main light-emitting control signal provided by the main light-emitting control signal terminal connected to the pixel compensation circuit group to be an invalid potential, and inputting by the first light-emitting control sub-circuit of each pixel compensation circuit of the k-th row of pixel compensation circuits a data signal from the data signal terminal to the second node in response to the driving power supply signal, the potential of the first node, and the power supply signal provided by the power supply terminal, where k is a positive integer not greater than K.

For example, assuming that each pixel compensation circuit group includes two rows of pixel compensation circuits, each driving stage can include two compensating sub-stages, i.e., K=2.

Step 503: during the light-emitting sub-stage, making the potential of the main light-emitting control signal connected to the pixel compensation circuit group to be a valid potential, and driving by the second light-emitting control sub-circuit connected to the target light-emitting control signal terminal of the M second light-emitting control sub-circuits of each pixel compensation circuit in the pixel compensation circuit group the light-emitting unit connected thereto to emit light in response to the target light-emitting control signal.

In some embodiments of the present disclosure, the driving principle of the pixel circuit provided by some embodiments of the present disclosure is described in detail by taking the case where the pixel circuit is as shown in FIG. 2 (i.e., both M and K are 2) and the pixel compensation circuit is as shown in FIG. 4 and each transistor in the pixel compensation circuit is a P-type transistor as an example.

Figure 6:
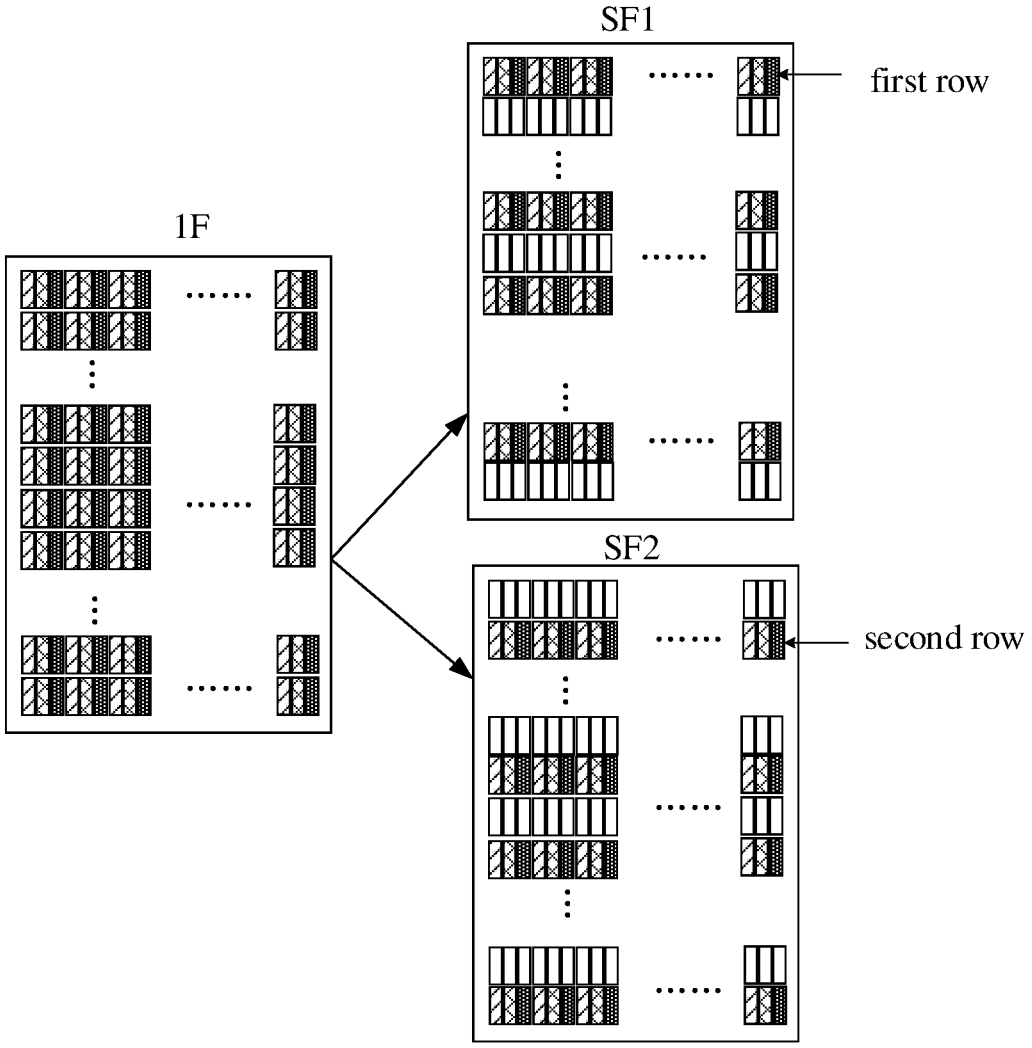
FIG. 6 is a schematic diagram of dividing a scan time of one frame into two driving sub-frames provided by at least one embodiment of the present disclosure.

Because a light-emitting unit group connected to each pixel compensation circuit of the pixel circuit includes two light-emitting units, i.e., M=2, the time when the pixel circuit performs scanning of one frame 1F on the light-emitting units in the display panel may be divided into two driving sub-frames SF1 and SF2 as shown in FIG. 6. Referring to FIG. 6, during the first driving sub-frame SF1, the pixel circuit may drive the light-emitting units of the odd-numbered rows in the display panel to emit light row by row, that is, during the first driving sub-frame SF1, the pixel circuit may sequentially drive the light-emitting units of the first row, the third row, the fifth row to the last odd-numbered row in the display panel to emit light; during the second driving sub-frame SF2, the pixel circuit may drive the light-emitting units of the even-numbered rows in the display panel to emit light row by row, that is, during the second driving sub-frame SF2, the pixel circuit may sequentially drive the light-emitting units of the second row, the fourth row, the sixth row, and the last even-numbered row in the display panel to emit light.

Figure 7:
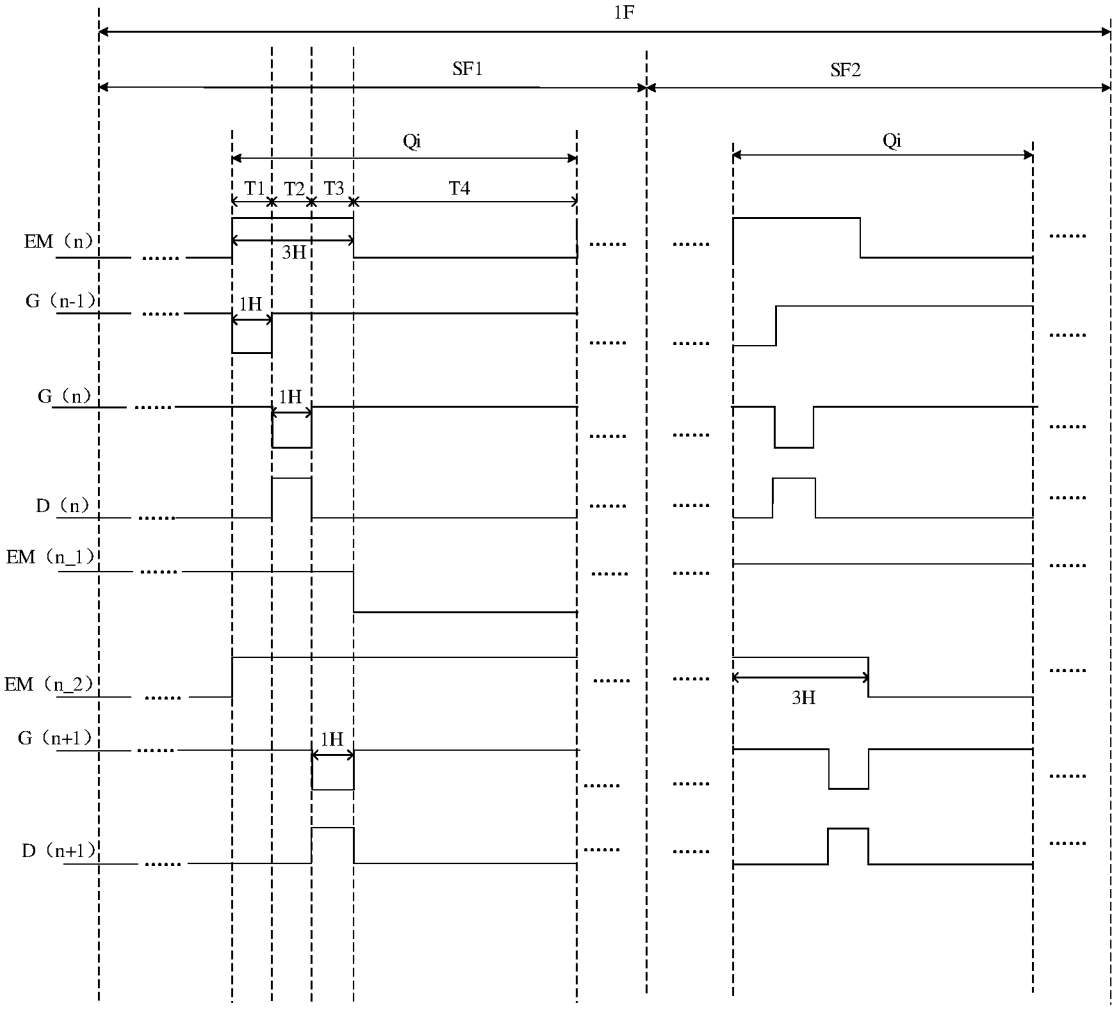
FIG. 7 is a timing diagram of a driving process of a pixel circuit provided by at least one embodiment of the present disclosure.

Referring to FIG. 7, the first driving sub-frame SF1 may include a plurality of driving stages, during the i-th driving stage Qi (i is a positive integer not greater than the number of driving stages included in each driving sub-frame) of the plurality of driving stages, the i-th light-emitting control signal terminal group corresponding to the i-th driving stage Qi may drive the i-th pixel compensation circuit group to operate. Assuming that the first row of pixel compensation circuits, in the two rows of pixel compensation circuits included in the i-th pixel compensation circuit group, is the n-th row of pixel compensation circuits in the display panel, then during the reset sub-stage T1 of the i-th driving stage Qi as shown in FIG. 7, a driving power supply terminal G(n−1) connected to the row of pixel compensation circuits (that is, the (n−1)-th row) before the n-th row of pixel compensation circuits in the display panel serves as a reset signal terminal of the n-th row of pixel compensation circuits to provide the reset signal having a valid potential. The second transistor M2 of each pixel compensation circuit in the n-th row of pixel compensation circuits in the display panel is turned on, and the reset power supply terminal Vint inputs a reset power supply signal having a valid potential to the first node P1 through the second transistor M2. The reset stage T1 may realize the resetting of the n-th row of pixel compensation circuits. In addition, during the reset sub-stage T1, the fifth transistor M5 of each pixel compensation circuit in the n-th row of pixel compensation circuits in the display panel is turned on.

Because one pixel compensation circuit group 01 includes two rows of pixel compensation circuits 011, i.e., K=2, each driving stage may include two compensating sub-stages T2 and T3 in the first driving sub-frame SF1. Referring to FIG. 7, during the first compensating sub-stage T2 of the i-th driving stage Qi, the potential of the driving power supply source signal provided by the driving power supply source terminal G(n) connected to the first row of pixel compensation circuits (i.e., the n-th row of pixel compensation circuits in the display panel) of the i-th pixel compensation circuit group is a valid potential. The third transistor M3 of each pixel compensation circuit in the n-th row of the pixel compensation circuits in the display panel is turned on, and the data signal terminal D inputs the data signal D to the second node P2 through the third transistor M3 and the fifth transistor M5 and stores the data signal and the threshold voltage of the fifth transistor M5 in the storage capacitor C.

Meanwhile, during the first compensating sub-stage T2 of the i-th driving stage Qi, the driving power supply terminal G(n) connected to the first row of pixel compensation circuits in the i-th pixel compensation circuit group (i.e., the n-th row of the pixel compensation circuits in the display panel) may also serve as a reset signal terminal of the second row of pixel compensation circuits (i.e., the (n+1)-th row of pixel compensation circuits in the display panel) of the i-th pixel compensation circuit group to provide a reset signal having a valid potential for the (n+1)-th row of pixel compensation circuits. The second transistor M2 of each pixel compensation circuit of the (n+1)-th row of pixel compensation circuits in the display panel is turned on, and the reset power supply terminal Vint may input a reset power supply signal having a valid potential to the first node P1 through the second transistor M2 to reset the (n+1)-th row of pixel compensation circuit. That is, the first compensating sub-stage T2 may also serve as a reset sub-stage of the (n+1)-th row of pixel compensation circuits.

During the second compensating sub-stage T3 of the i-th driving stage Qi, the potential of the driving power supply signal provided by the driving power supply terminal G(n+1) connected to the second row of pixel compensation circuits (i.e., the (n+1)-th row of pixel compensation circuits in the display panel) of the i-th pixel compensation circuit group is a valid potential. The third transistor M3 of each pixel compensation circuit of the (n+1)-th row of pixel compensation circuits in the display panel is turned on, and because the fifth transistor M5 is also turned on at this time, the data signal terminal D inputs the data signal D(n+1) to the second node P2 through the third transistor M3 and the fifth transistor M5, and stores the data signal and the threshold voltage of the fifth transistor M5 in the storage capacitor C.

In addition, during the reset sub-stage T1 and each of the compensating sub-stages T2 and T3, the potential of the main light-emitting control signal provided by the main light-emitting control signal terminal EMc connected to the first row of pixel compensation circuits and the second row of pixel compensation circuits (i.e., the n-th row of pixel compensation circuits and the (n+1)-th row of pixel compensation circuits in the display panel) of the i-th pixel compensation circuit group is an invalid potential. Both the fourth transistor M4 of each pixel compensation circuit of the n-th row of pixel compensation circuits in the display panel and the fourth transistor M4 of each pixel compensation circuit of the (n+1)th row of pixel compensation circuits in the display panel are turned off.

Furthermore, during the light-emitting sub-stage T4 of the i-th driving stage Qi of the first driving sub-frame SF1, the potential of the main light-emitting control signal provided by the main light-emitting control signal terminal EMc connected to each pixel compensation circuit of the i-th pixel compensation circuit group is shifted to a valid potential. Both the fourth transistor M4 of each pixel compensation circuit of the n-th row of pixel compensation circuits in the display panel and the fourth transistor M4 of each pixel compensation circuit of the (n+1)-th row of pixel compensation circuits in the display panel are turned on. The power supply terminal ELVDD may input a power supply signal to the second node P2 through the fourth transistor M4 and the fifth transistor M5. The potential of the light-emitting control signal provided by the first light-emitting control signal terminal EM(n_1) of the i-th light-emitting control signal terminal group is a valid potential. The first transistor M1 corresponding to the first light-emitting control signal terminal EM(n_1) of each pixel compensation circuit of the n-th row and the (n+1)-th row of pixel compensation circuits in the display panel is turned on, and the second node P2 is turned on, and the second node P2 may drive the light-emitting unit connected to the first transistor M1 to emit light through the first transistor M1. That is, in a light-emitting unit group connected to each pixel compensation circuit of the n-th row and the (n+1)-th row of pixel compensation circuits in the display panel, the light-emitting unit corresponding to the first light-emitting control signal terminal EM(n_1) emits light. For example, during the light-emitting sub-stage of the i-th driving stage Qi, the first light-emitting unit connected to each pixel compensation circuit of the n-th row of pixel compensation circuits in the display panel and the first light-emitting unit connected to each pixel compensation circuit of the (n+1)-th row of pixel compensation circuits in the display panel may emit light at the same time.

In some embodiments of the present disclosure, when a pixel compensation circuit group includes two rows of pixel compensation circuits, only one compensating sub-stage is required to be added in each driving stage, and the duration of the light-emitting sub-stage in each drive stage is reduced by the duration of one compensating sub-stage correspondingly. The duration of each sub-stage in each driving stage may be 1H, where 1H refers to the length of time required for the pixel circuit to scan a row of light-emitting units, and the 1H satisfies: $1H=1/(f\times S)$, f is the frame frequency, and S is the total number of rows of the light-emitting units included in the display panel. Because the compensating sub-stage of 1H is added to each driving stage, the light-emitting duration is reduced by 1H correspondingly, but because the display panel includes a plurality of rows of light-emitting units, the effect of reducing the duration of the light-emitting sub-stage by 1H on the display performance of the display panel is negligible.

Referring to FIG. 7, during the light-emitting sub-stage of the i-th driving stage Qi of the second driving sub-frame SF2, the potential of the light-emitting control signal provided by the second light-emitting control signal terminal EM(n_2) of the i-th light-emitting control signal terminal group is a valid potential, and the potential of the light-emitting control signal provided by the first light-emitting control signal terminal EM(n_1) of the i-th light-emitting control signal terminal group is shifted to an invalid potential. The first transistor M1 corresponding to the second light-emitting control signal terminal EM(n_2) of each pixel compensation circuit of the n-th row and the (n+1)-th row of pixel compensation circuits in the display panel is turned on, and the second node P2 may drive the light-emitting unit connected to the first transistor M1 to emit light through the first transistor M1. That is, in a light-emitting unit group connected to each pixel compensation circuit of the n-th row and the (n+1)-th row of pixel compensation circuits in the display panel, the light-emitting unit corresponding to the second light-emitting control signal terminal EM(n_2) emits light. For example, during the light-emitting sub-stage of the i-th driving stage Qi, the second light-emitting unit connected to each pixel compensation circuit of the n-th row of pixel compensation circuits in the display panel and the second light-emitting unit connected to each pixel compensation circuit of the (n+1)-th row of pixel compensation circuit in the display panel may emit light at the same time.

It should be noted that in each of the above embodiments, the description has been made by taking the case where each transistor is a P-type transistor and the valid potential is a low potential as an example. Certainly, each transistor may also be an N-type transistor, and when each transistor is an N-type transistor, the valid potential may be a high potential.

In summary, in the method of driving the pixel circuit provided by at least one embodiment of the present disclosure, because during an light-emitting sub-stage of each driving stage, a pixel compensation circuit group (i.e., K rows of the pixel compensation circuits) connected to the target control signal terminal may drive the corresponding light-emitting unit to emit light under the control of the target light-emitting control signal terminal, the number of signal terminals required to be disposed is reduced, and the area of the circuit board occupied by the pixel circuit is further reduced, which is more advantageous for the implementation of the display panel with a narrow bezel.

In addition, at least one embodiment of the present disclosure further provides a display device, which may include a pixel circuit as shown in FIGS. 1 to 4 and a plurality of light-emitting unit groups, each light-emitting unit group includes M light-emitting units, and M is an integer greater than 1. Each pixel compensation circuit in the pixel circuit is connected to a light-emitting unit group. The display device may be any product or component having a display function, such as a Micro-LED display substrate, a liquid crystal panel, an electronic paper, an AMOLED panel, a mobile phone, a tablet computer, a television, a display, a notebook computer, a digital photo frame, a navigator, and the like.

Figure 8:
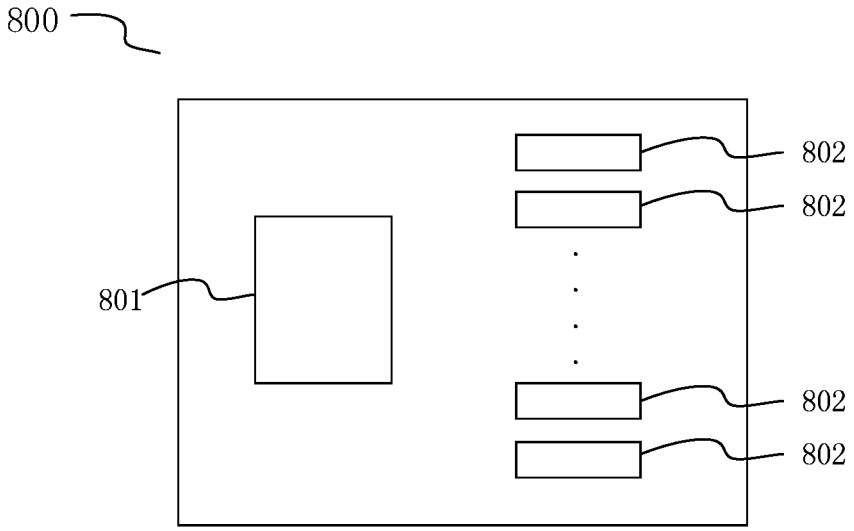
FIG. 8 is a schematic structural diagram of a display device provided by at least one embodiment of the present disclosure.

As shown in FIG. 8, the display device 800 according to at least one embodiment of the present disclosure includes a pixel circuit 801 and a plurality of light-emitting unit groups 802, in which the pixel circuit 801 may be any of the above pixel circuits, and the light-emitting unit 802 may be any of the above light-emitting units.

Those skilled in the art can clearly understand that the particular operation process of the pixel circuit and the display device described above can refer to the corresponding process in the foregoing method embodiments, and the repeated description will be omitted for convenience and brevity.

The above is only an exemplary embodiment of the present disclosure, and is not intended to limit the scope of the present disclosure. The scope of the present disclosure is defined by the appended claims.

What is claimed is:

1. A pixel circuit, comprising a plurality of pixel compensation circuit groups arranged in an array, each pixel compensation circuit group comprising K rows of pixel compensation circuits, K being an integer greater than 1, and each row of pixel compensation circuits comprising at least one pixel compensation circuit;

wherein each pixel compensation circuit is configured to be connected to a light-emitting unit group in operation, the light-emitting unit group comprises M light-emitting units located in a same column, M is an integer greater than one;

the pixel circuit further comprises a plurality of light-emitting control signal terminal groups that are in one-to-one correspondence with the plurality of pixel compensation circuit groups, each light-emitting control signal terminal group comprises M light-emitting control signal terminals, and each pixel compensation circuit of each pixel compensation circuit group is connected to M light-emitting control signal terminals of a corresponding light-emitting control signal terminal group; and the M light-emitting control signal terminals connected to each pixel compensation circuit are in one-to-one correspondence with the M light-emitting units connected to the pixel compensation circuit, and each light-emitting control signal terminal is configured to drive a corresponding light-emitting unit to emit light through the pixel compensation circuit connected to the light-emitting control signal terminal;

wherein a scan time of one frame comprises a plurality of driving sub-frames, each driving sub-frame comprises a plurality of driving stages, and a count of the plurality of driving stages is equal to a count of the plurality of pixel compensation circuit groups, the plurality of pixel compensation circuit groups are in an active state in the plurality of driving stages respectively, and in one driving stage, only one pixel compensation circuit group among the plurality of pixel compensation circuit groups is in the active state, wherein the one pixel compensation circuit group being in the active state indicates that one of M light-emitting units connected to each pixel compensation circuit in the one pixel compensation circuit group is driven to emit light in the one driving stage.

2. The pixel circuit according to claim 1, further comprising a plurality of main light-emitting control signal terminals that are in one-to-one correspondence with the plurality of pixel compensation circuit groups, and each main light-emitting control signal terminal is connected to each pixel compensation circuit of a corresponding pixel compensation circuit group.

3. The pixel circuit according to claim 1, wherein the M light-emitting units located in the same column of each light-emitting unit group are adjacent to each other.

4. The pixel circuit according to claim 3, wherein

M=2.

5. The pixel circuit according to claim 1, wherein the K rows of pixel compensation circuits of each pixel compensation circuit group are adjacent to each other.

6. The pixel circuit according to claim 5, wherein

K=2.

7. The pixel circuit according to claim 1, wherein an m-th light-emitting control signal terminal of the M light-emitting control signal terminals connected to each pixel compensation circuit corresponds to an m-th light-emitting unit of the M light-emitting units connected to the pixel compensation circuit, and m is a positive integer not greater than M.

8. The pixel circuit according to claim 2, wherein each pixel compensation circuit comprises a reset sub-circuit, a first light-emitting control sub-circuit, and M second light-emitting control sub-circuits;

the reset sub-circuit is connected to a reset signal terminal and a reset power supply terminal, the reset sub-circuit is connected to the first light-emitting control sub-circuit at a first node, and the reset sub-circuit is configured to input a reset power supply signal from the reset power supply terminal to the first node in response to a reset signal from the reset signal terminal;

the first light-emitting control sub-circuit is connected to the main light-emitting control signal terminal, a power supply terminal, a data signal terminal and a driving power supply terminal, the first light-emitting control sub-circuit is connected to the M second light-emitting control sub-circuits at a second node, and the first light-emitting control sub-circuit is configured to input a data signal from the data signal terminal to the second node in response to a potential of the first node, a main light-emitting control signal from the main light-emitting control signal terminal, a power supply signal from the power supply terminal, and a drive power supply signal from the drive power supply terminal; and each second light-emitting control sub-circuit is connected to one light-emitting control signal terminal of a corresponding light-emitting control signal terminal group and a light-emitting unit, and each second light-emitting control sub-circuit is configured to drive the light-emitting unit connected to the second light-emitting control sub-circuit to emit light in response to an light-emitting control signal from the light-emitting control signal terminal connected to the second light-emitting control sub-circuit.

9. The pixel circuit according to claim 8, wherein each second light-emitting control sub-circuit comprises a first transistor;

a gate electrode of the first transistor is connected to one light-emitting control signal terminal, a first electrode of the first transistor is connected to the second node, and a second electrode of the first transistor is connected to one light-emitting unit.

10. The pixel circuit according to claim 8, wherein the reset sub-circuit comprises a second transistor;

a gate electrode of the second transistor is connected to the reset signal terminal, a first electrode of the second transistor is connected to a reset power supply terminal, and a second electrode of the second transistor is connected to the first node;

the first light-emitting control sub-circuit comprises a third transistor, a fourth transistor, a fifth transistor, a sixth transistor, and a storage capacitor;

a gate electrode of the third transistor is connected to the driving power supply terminal, a first electrode of the third transistor is connected to the data signal terminal, and a second electrode of the third transistor is connected to a third node;

a gate electrode of the fourth transistor is connected to the main light-emitting control signal terminal, a first electrode of the fourth transistor is connected to the third node, and a second electrode of the fourth transistor is connected to the power supply terminal;

a gate electrode of the fifth transistor is connected to the first node, a first electrode of the fifth transistor is connected to the third node, and a second electrode of the fifth transistor is connected to the second node;

a gate electrode of the sixth transistor is connected to the driving power supply terminal, a first electrode of the sixth transistor is connected to the first node, and a second electrode of the sixth transistor is connected to the second node; and an terminal of the storage capacitor is connected to the power supply terminal, and a remaining terminal of the storage capacitor is connected to the first node.

11. A method of driving a pixel circuit, wherein the pixel circuit comprises a plurality of pixel compensation circuit groups arranged in an array, each pixel compensation circuit group comprises K rows of pixel compensation circuits, K is an integer greater than 1, and each row of pixel compensation circuits comprises at least one pixel compensation circuit, each pixel compensation circuit is configured to be connected to a light-emitting unit group in operation, the light-emitting unit group comprises M light-emitting units located in a same column, M is an integer greater than one, the pixel circuit further comprises a plurality of light-emitting control signal terminal groups that are in one-to-one correspondence with the plurality of pixel compensation circuit groups, each light-emitting control signal terminal group comprises M light-emitting control signal terminals, and each pixel compensation circuit of each pixel compensation circuit group is connected to M light-emitting control signal terminals of a corresponding light-emitting control signal terminal group, the M light-emitting control signal terminals connected to each pixel compensation circuit are in one-to-one correspondence with the M light-emitting units connected to the pixel compensation circuit, and each light-emitting control signal terminal is configured to drive a corresponding light-emitting unit to emit light through the pixel compensation circuit connected to the light-emitting control signal terminal, wherein a scan time of one frame comprises a plurality of driving sub-frames, each driving sub-frame comprises a plurality of driving stages, and a count of the plurality of driving stages is equal to a count of the plurality of pixel compensation circuit groups, the plurality of pixel compensation circuit groups are in an active state in the plurality of driving stages respectively, and in one driving stage, only one pixel compensation circuit group among the plurality of pixel compensation circuit groups is in the active state, wherein the one pixel compensation circuit group being in the active state indicates that one of M light-emitting units connected to each pixel compensation circuit in the one pixel compensation circuit group is driven to emit light in the one driving stage; and the method comprises: driving the pixel circuit through M driving sub-frames, each driving sub-frame comprises a plurality of driving stages, a number of the driving stages in each driving sub-frame is equal to a number of the pixel compensation circuit groups and a number of the light-emitting control signal terminal groups in the pixel circuit, and the plurality of driving stages are in one-to-one correspondence with the plurality of light-emitting control signal terminal groups, and the driving the pixel circuit through the M driving sub-frames comprises: during a light-emitting sub-stage of each driving stage, making a potential of a target light-emitting control signal provided by a target light-emitting control signal terminal of the M light-emitting control signal terminals in a corresponding light-emitting control signal terminal group to be a valid potential, making a potential of a light-emitting control signal provided by a remaining light-emitting control signal terminal other than the target light-emitting control signal terminal in the corresponding light-emitting control signal terminal group to be an invalid potential, and driving, by the pixel compensation circuit group connected to the target light-emitting control signal terminal, the light-emitting unit corresponding to the target light-emitting control signal terminal to emit light under a control of the target light-emitting control signal.

12. The method according to claim 11, wherein the pixel circuit further comprises a plurality of main light-emitting control signal terminals that are in one-to-one correspondence with the plurality of pixel compensation circuit groups, each main light-emitting control signal terminal is connected to each pixel compensation circuit of a corresponding pixel compensation circuit group; and the driving the pixel circuit through the M driving sub-frames further comprises: during the light-emitting sub-stage of each driving stage, making a potential of a main light-emitting control signal provided by the main light-emitting control signal terminal corresponding to the pixel compensation circuit group connected to the target light-emitting control signal terminal to be a valid potential.

13. The method according to claim 11, wherein each light-emitting unit group comprises two light-emitting units located in the same column and adjacent to each other, and each light-emitting control signal terminal group comprises two light-emitting control signal terminals;

the driving the pixel circuit by the M driving sub-frames comprises: driving the pixel circuit by two driving sub-frames; and the driving the pixel circuit by two driving sub-frames comprises:

during the light-emitting sub-stage of each driving stage of a first driving sub-frame of the two driving sub-frames, making a potential of a light-emitting control signal provided by one light-emitting control signal terminal of the light-emitting control signal terminal group corresponding to the driving stage to be a valid potential, and making a potential of a light-emitting control signal provided by a remaining light-emitting control signal terminal to be an invalid potential; and during the light-emitting sub-stage of each driving stage of a second driving sub-frame of the two driving sub-frames, making the potential of the light-emitting control signal provided by the remaining light-emitting control signal terminal of the light-emitting control signal terminal group corresponding to the driving stage to be a valid potential, and making the potential of the light-emitting control signal provided by the one light-emitting control signal terminal other than the remaining light-emitting control signal terminal to be an invalid potential.

14. The method according to claim 12, wherein each pixel compensation circuit comprises a reset sub-circuit, a first light-emitting control sub-circuit, and M second light-emitting control sub-circuits;

each driving stages further comprises a reset sub-stage and K compensating sub-stages before the light-emitting sub-phase; and the driving the pixel circuit through the M driving sub-frames further comprises:

during the reset sub-phase, making a potential of a reset signal provided by a reset signal terminal of a first row of pixel compensation circuits of one pixel compensation circuit group connected to one light-emitting control signal terminal group corresponding to the driving stage to be a valid potential, and inputting, by the reset sub-circuit, a reset power supply signal from a reset power supply terminal to a first node in response to the reset signal;

during a k-th compensating sub-stage of the K compensating sub-stages, making a potential of a driving power supply signal provided by a driving power supply terminal connected to a k-th row of pixel compensation circuit of the one pixel compensation circuit group to be a valid potential, making a potential of a main light-emitting control signal provided by the main light-emitting control signal terminal connected to the one pixel compensation circuit group to be an invalid potential, and inputting, by the first light-emitting control sub-circuit of each pixel compensation circuit of the k-th row of pixel compensation circuits, a data signal from a data signal terminal to the second node in response to the driving power supply signal, a potential of the first node, and a power supply signal provided by a power supply terminal, k being a positive integer not greater than K; and during the light-emitting sub-stage, making a potential of the main light-emitting control signal connected to the one pixel compensating circuit group to be a valid potential, and driving, by the second light-emitting control sub-circuit, among the M second light-emitting control sub-circuits in each pixel compensation circuit of the one pixel compensation circuit group, connected to the target light-emitting control signal terminal, the light-emitting unit connected to the second light-emitting control sub-circuit to emit light in response to the target light-emitting control signal.

15. A display device, comprising:

a pixel circuit; and a plurality of light-emitting unit groups, each light-emitting unit group comprising M light-emitting units, M being an integer greater than 1, wherein the pixel circuit comprises a plurality of pixel compensation circuit groups arranged in an array, each pixel compensation circuit group comprises K rows of pixel compensation circuits, K is an integer greater than 1, and each row of pixel compensation circuits comprises at least one pixel compensation circuit, the pixel circuit further comprises a plurality of light-emitting control signal terminal groups that are in one-to-one correspondence with the plurality of pixel compensation circuit groups, each light-emitting control signal terminal group comprises M light-emitting control signal terminals, and each pixel compensation circuit of each pixel compensation circuit group is connected to M light-emitting control signal terminals of a corresponding light-emitting control signal terminal group, the M light-emitting control signal terminals connected to each pixel compensation circuit are in one-to-one correspondence with the M light-emitting units connected to the pixel compensation circuit, and each light-emitting control signal terminal is configured to drive a corresponding light-emitting unit to emit light through the pixel compensation circuit connected to the light-emitting control signal terminal, wherein a scan time of one frame comprises a plurality of driving sub-frames, each driving sub-frame comprises a plurality of driving stages, and a count of the plurality of driving stages is equal to a count of the plurality of pixel compensation circuit groups, the plurality of pixel compensation circuit groups are in an active state in the plurality of driving stages respectively, and in one driving stage, only one pixel compensation circuit group among the plurality of pixel compensation circuit groups is in the active state, wherein the one pixel compensation circuit group being in the active state indicates that one of M light-emitting units connected to each pixel compensation circuit in the one pixel compensation circuit group is driven to emit light in the one driving stage, and each pixel compensation circuit in the pixel circuit is connected to one of the light-emitting unit groups.

16. The pixel circuit according to claim 2, wherein the M light-emitting units located in the same column of each light-emitting unit group are adjacent to each other.

17. The pixel circuit according to claim 2, wherein the K rows of pixel compensation circuits of each pixel compensation circuit group are adjacent to each other.

18. The pixel circuit according to claim 3, wherein the K rows of pixel compensation circuits of each pixel compensation circuit group are adjacent to each other.

19. The pixel circuit according to claim 4, wherein the K rows of pixel compensation circuits of each pixel compensation circuit group are adjacent to each other.

20. The pixel circuit according to claim 2, wherein an m-th light-emitting control signal terminal of the M light-emitting control signal terminals connected to each pixel compensation circuit corresponds to an m-th light-emitting unit of the M light-emitting units connected to the pixel compensation circuit, and m is a positive integer not greater than M.

* * * * *